United States Patent [19]

Crimes

[11] 4,046,559

[45] Sept. 6, 1977

[54] PYROMETALLURGICAL SYSTEM FOR LIQUID-LIQUID CONTACTING

[75] Inventor: Peter B. Crimes, Sudbury, Mass.

[73] Assignee: Kennecott Copper Corporation, New York, N.Y.

[21] Appl. No.: 660,020

[22] Filed: Feb. 23, 1976

[51] Int. Cl.[2] ..... C22C 9/00; B01F 9/10

[52] U.S. Cl. ..... 75/93 R; 75/61; 259/85

[58] Field of Search ..... 75/93, 61; 259/85

[56] References Cited

U.S. PATENT DOCUMENTS

| | | | |
|---|---|---|---|
| 3,459,536 | 8/1969 | Touzalin | 75/93 R |
| 3,554,518 | 1/1971 | Ostberg | 75/61 |
| 3,592,629 | 7/1971 | Ando | 75/93 R |
| 3,664,826 | 5/1972 | Kraemer | 75/93 R |
| 3,871,872 | 3/1975 | Downing | 75/93 R |
| 3,915,694 | 10/1975 | Ando | 75/61 |

*Primary Examiner*—Peter D. Rosenberg

*Attorney, Agent, or Firm*—Anthony M. Lorusso; John L. Sniado

[57] ABSTRACT

Disclosed is a pyrometallurgical system and method for optimizing the interfacial contact in a two liquid system for promoting a reaction dependent upon such interfacial contact. Results are presented which indicate that, while the reaction rate initially increases rapidly with a mixing of the two liquids, excessive mixing produces little additional benefit in the reaction rate, can lead to damage of vessel walls, and can lead to a great increase in the "settling out" time of one liquid from the other (or even a complete emulsification). The specification identifies key parameters in the design of a suitable stirrer blade assembly and presents an analysis intended to yield an optimized blade design.

29 Claims, 3 Drawing Figures

PYROMETALLURGICAL SYSTEM FOR LIQUID-LIQUID CONTACTING

BACKGROUND OF THE INVENTION

In general, the present invention is directed to systems wherein it is desired to mix two liquids having greatly differing densities upon the interaction of the two liquids. In particular, the invention relates to an improved design for a mechanical stirrer for a pyrometallurgical system of the type described in the U.S. Pat. No. 3,861,660, issued Jan. 21, 1975 owned by the assignee of the present invention, and incorporated herein by reference.

Liquid-liquid systems having large differences in specific gravities (e.g., at least 0.5), as well as such systems in which each liquid has a high specific gravity (e.g., at least 3.0) present unusual mixing problems. Where the liquids are at very high temperatures (e.g., pyrometallurgical slags and mattes) an additional problem is the erosion of vessel walls caused by turbulence of the liquids adjacent those walls.

According to the present invention it has been realized that certain stirrer parameters are important in optimizing the desired results in pyrometallurigical systems in which (a) particulate solid-liquid contacting is required and (b) liquid-liquid contacting is required. The present invention is directed to the latter improvements and my contemporaneously filed U.S. Pat. application entitled "Pyrometallurgical System for Solid-Liquid Contacting" is directed to the former improvements.

In various pyrometallurgical operations, contact between two liquid phases is required to achieve rapid reaction rates. An example is the extraction of molybdenum by the contacting of an iron-rich matte and molybdenum-bearing slags. In such operations in general, and in the extraction of molybdenum in particular, there is typically a lower denser liquid (i.e., the matte) and an upper lighter liquid (i.e., the slag). In order to achieve the benefits concerning freezing of slag on the stirrer as described in the aforementioned U.S. Pat. No. 3,861,660, the stirrer blade assembly must be suspended in the slag the upper liquid). Thus, the successful enhancement of reaction rates must be provided with the scope of this constraint on stirrer placement.

It is thus a principle object of the present invention to provide an improved stirrer for use in a pyrometallurgical system which will efficiently promote a high reaction rate between liquids of different densities while being supported in the upper liquid.

It is a further object to provide such a stirrer which will so enhance the reaction rate without substantially imparing the phase separation of the two liquids or causing excessive damage to the reactor'walls.

SUMMARY OF THE INVENTION

Briefly, the invention features a method of promoting a reaction between a first denser material and a second lighter material, the materials having densities differing by at least about 0.5. The method comprises the steps of maintaining both materials in a liquid state in a vessel defined by a square of side W or by a circle of diameter 1.3W, the lighter liquid having a depth of H; supporting a stirrer with a blade assembly immersed in the lighter liquid and having a dimater, D, of approximately 0.1W to 0.4W; and rotating the stirrer at a rate N (RPM) such that the denser liquid is drawn up to the blade assembly, is pumped radially outward, and is formed into droplets by shear forces developed by the rotating blade assembly, and also such that the lighter liquid is circulated through the cloud of droplets thus formed; whereby a large area of contact between the liquids is produced without emulsification. Preferably, the method further includes the step of providing a blade assembly having a height, B, of approximately 0.05H to approximately 0.5H.

Where a vessel with a circular cross section is used the volume V is defined by a circle of diameter 1.13W and depth H. Circular cross section vessels preferably have wall baffles, as is commonly practiced. In all other respects, the computations and derivatives concerning blades geometry, rotational speed, and placement as discussed herein are to be considered as equivalent to those for vessels of generally square cross sections where V is defined by a square of side W and depth H. For the sake of brevity only vessels of square cross section configuration will be described herein in detail. The principal criteria of stirrer pumping rate per unit volume and vortex strength are equivalent for square or round cross section vessels. The ratios of blade dimensions to vessel dimensions are substantially equivalent, differing by only about 13% and are accounted for by using the expression 1.13W in the derivations in place of W.

In another aspect, the invention features a stirrer for the non-emulsifying mixing of a lower denser liquid into a volume of an upper, lighter liquid, the volume defined by a square of side W or by a circle of diameter 1.13W and depth H. The stirrer comprises a shaft and a paddle blade of diameter D, where D is approximately 0.1W to 0.4W; means for rotating the paddle at a rate N RPM, such that the lower liquid is drawn up to the blade assembly, is pumped radially outward therefrom, and is divided into droplets by shear forces developed by said rotating blade assembly; and such that the upper liquid is circulated through the cloud of droplets thus formed; whereby a large area of contact between the liquids is produced without emulsification. Preferably, the paddle height is about 0.05H to about 0.5H and a baffle plate is secured to the stirrer shaft above the blade.

This stirrer configuration is predicated upon the present discovery that the increased dispersion of the lower, denser phase through the upper, lighter phase is strongly affected by the values of the paddle diameter and the rate of rotation. It has been discovered, that for a given height of the paddle above the phase interface, the dispersion of the lower phase into the upper phase initially increases dramatically with an increased rotation rate and/or paddle blade diameter. Because the amount of dispersion levels off, however, excessive increases in rotation rate and/or paddle blade diameter would only cause erosion of vessel linings. Furthermore, it has been discovered that the tip speed of the paddle should be kept to a minimum in order to avoid the formation of droplets of the lower phase in the upper phase which are so small that phase separation is impaired (i.e., an effective emulsification has occurred). In order to avoid erosion of the walls of the vessel containing the liquids, it has been determined that an upper limit for the blade diameter, D, is approximately 0.1W to 0.4W, where W is the width of the vessel. The radial pumping of the lower phase to form a cloud of droplets in the lowermost portion of the upper phase is just part of the circulation pattern of the liquid-liquid system. The reaction rate between the liquids is further enhanched by a circulation of the upper phase through the cloud of droplets of lower phase material. This circulation of the upper phase through the cloud of droplets assures that, in addition to having a large interfacial area of contact between the two phases, fresh portions of the upper phase will be continuously brought into contact with the lower phase across this increased interfacial area.

BRIEF DESCRIPTION OF THE DRAWINGS

Other objects, features, and advantages of the invention will appear from the following description of a particular preferred embodiment, taken together with the accompanying drawings in which.

DETAILED DESCRIPTION OF PARTICULAR PRFERRED EMBODIMENTS

As indicated above, the present invention concerns a reactor which is designed to promote and facilitate very fast reaction rates in pyrometallurigical systems involving at least two liquids of different densities, particularly molten slags and mattes (molten sulfides). While the invention has broad application to promoting reactions between liquids of differing densities, most commonly one of the liquids will be a molten slag. As used herein, the term "slag" is intended to encompass a wide variety of materials generally referred to as slag in the art; principally silicate-based materials associated with the production of metals.

Figure 1:
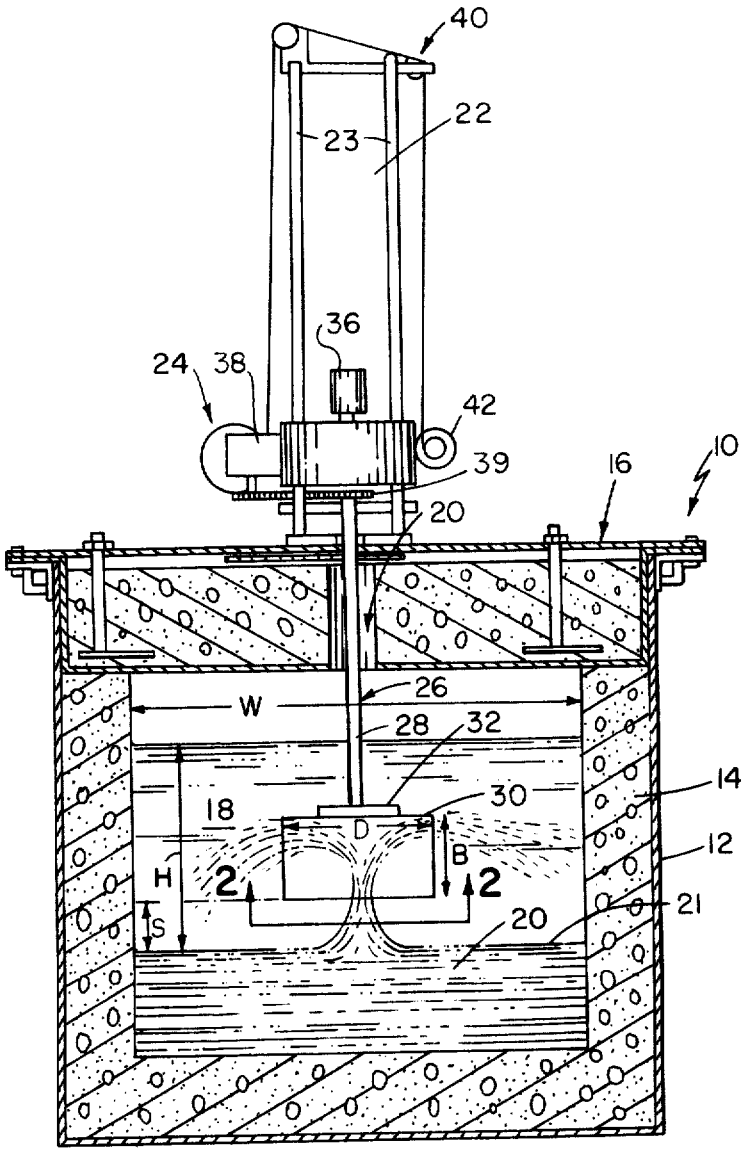
FIG. 1 is a somewhat idealized sectional view of a pyrometallurgical reactor comprising a vessel and a mechanical agitator, the system incorporating features of the present invention.

Referring to FIG. 1, there is shown a reactor 10 of the type used in matte-slag reactions. It should be understood that such reactors often consist of vessels connected in series for flow of constituent liquids between the various vessels. The construction is, of course, well known in the art and the description below of the vessel of FIG. 1 would apply equally to other vessels of such a series, with possible minor modifications. It should also be understood that the improvements of the present invention may be useful in other types of furnaces, ladles, and reactors in which the controlled mixing of liquid phases of differing densities is desired.

Referring still to FIG. 1, the reactor 10 comprises a steel box 12 having a refractory lining 14 and a conventional cover 16. A slag 18 floats on top of a denser matte 20 with the depth of the slag being H. The furnace can be heated in any conventional manner and thus, for simplicity, no specific heating means is shown. Similarly, any conventional means for charging and/or emptying the reactor may be provided.

A frame 22 supported on the reactor cover 16 supports a variable speed drive means 24 at any of a plurality of selectable heights above the upper surface of cover 16. The drive means 24 rotates a stirrer 26 which comprises a shaft 28, a blade assembly 30 secured to the shaft's lower end for rotation therewith, and a baffle plate 32 secured to the shaft immediately above the blade assembly 30. The blade assembly 30 has a diameter D, a breadth (or height) B, and is supported at a distance S above the interface 34 between the slag 18 and the matte 20 when the liquids are at rest.

The inside dimensions of the reactor 10 are defined by a square of side W or by a circle of diameter 1.13W and the depth of the slag H. The total volume of slag mixed by the stirrer 26 is denoted V. In FIG. 1, the volume of slag contained in the reactor vessel 10 is $V=(H)(W^2)=cW^3$; where $H=cW$ and $c$, the "cell ratio", typically is less than 1.0. As explained in a patent application entitled "Mechanically Stirred Electric Furnace for Pyrometallurgical Operations," filed concurrently herewith and owned by the Assignee of the present invention, under various circumstances it is desirable to divide the volume of pyrometallurgical reactors into a plurality of "unit cells," each mixed by a separate stirrer. (In particular, for matte-slag reactors comprising vessels connected in series, each such vessel would be separately stirred by one or more stirrers 26.) With multiple unit cells, the analysis below would apply to each individual unit cell and its stirrer.

The internal construction of the stirrer 26, as well as the means by which it is supported and driven, are preferably as described in the previously mentioned U.S. Pat. No. 3,861,660. Thus, internal conduits (not shown) for fluid cooling are provided in the shaft 28 and extend into the blase assembly 30. A cooling fluid delivery assembly is provided at the upper end of the shaft 28. The stirrer is rotated by a motor 38 driving a belt 39, which engages a sprocket secured to the stirred shaft 28. The drive assembly 24 is mounted on guides 23 which are secured to frame 22. A pulley system 40 and motor 42 are provided for raising and lowering the entire stirrer and stirrer drive assembly, thereby permitting adjustment of the distance, S, of the blade assembly 30 above the liquid-liquid interface 21.

Figure 2:
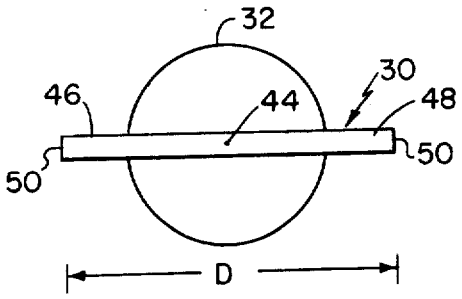
FIG. 2 is a bottom plan view of the mechanical agitator of FIG. 1, taken at 2—2 of FIG. 1.

The blade assembly 30 is preferably formed from copper because of its high thermal conductivity, as explained in the above-mentioned U.S. Pat. No. 3,861,660. As best seen in FIG. 2, in the illustrated embodiment the blade assembly comprises the unitary rectangular block symmetrically disposed about the shaft axis 44 providing diametrically opposed blade portions 46 and 48.

Since the stirrer 26 is immersed in the slag 18 in order to freeze a layer of slag over the blade assembly 30, as taught in the above-mentioned U.S. Pat. No. 3,861,660, mixing of the slag 18 and the matte 20 must occur by drawing up the matte into the slag 18 and then dispersing it. It has been discovered that very rapid reaction rates are achievable when the blade assembly 30 acts to disperse the matte in the form of droplets which are formed by the shear forces developed in the slag 18 at the tips 50 (see FIG. 2) of the rotating blade assembly 30. Furthermore, while prior to the present invention it might have seemed that the reaction rate should increase uniformly with the degree of mixing of the two phases (i.e., the slag 18 and the matte 20), according to the present invention it has been discovered that the reaction rates increase rapidly with the degree of mixing at first but then substantially level off. Thus, a further increase in the degree of mixing, with an additional energy input required for the stirrer 26, produces only small increases in reaction rate and can also generate such minute droplets of the matte in the slag that phase separation, after completion of the reaction, is difficult or impossible (i.e., the liquids are effectively emulsified).

It has been discovered that the larger the diameter, D, of the blade assembly 30, the more easily the stirrer dispersed the matte phase. Thus, for a given circulation rate of the matte in the slag, the required speed of the paddle was smallest for the largest diameter paddle since a lower rate of rotation, N (in RPM), was possible. The low tip speed also minimizes the maximum shear forces at the blade tips, which would produce excessively small droplets of matte. A competing blade requirement, however, involves the desire to not create excessive liquid turbulence near the walls of the vessel 10 so that excessive erosion of the refractory lining 14 does not occur. According to the present invention it has been discovered that these apparently competing requirements of blade design can be accommodated by making the value of $D$ approximately $0.29W$; that is $W/D = 3.5$. While it has been discovered that the value of the breadth, $B$, has much less effect upon the dispersion of matte droplets in the slag, it has been determined that a suitable value for $B$ is approximately 0.125H; that is $(B/H)=(\frac{1}{8})$.

The baffle plate 32 enhances the flow of matte from beneath the blade assembly 30, since the liquid radially pumped from the blade assembly can be replaced only from below, thereby providing for a greater dispersion of matte droplets in the slag 18 for a given rate of rotation of the mechanical stirrer 26. The baffle plate 32 also suppresses the development of a gas vortex at the upper surface of the slag 18 which would lead to gas entrainment in the slag.

Figure 3:
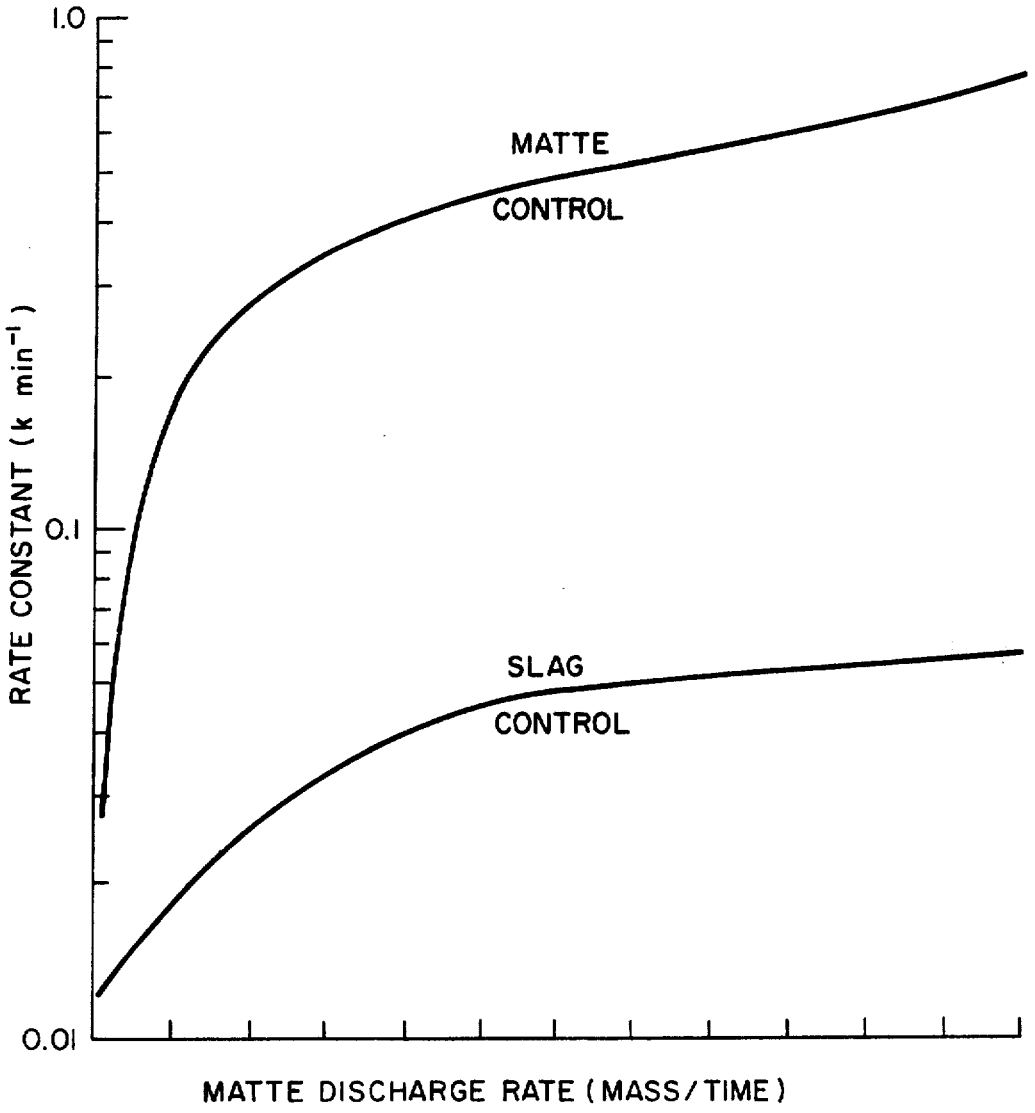
FIG. 3 is a graph illustrating the dependence of a reaction rate constants as a function of the volumetric matte discharge rate from the stirrer.

As mentioned above, it has been discovered that the reaction rate increases very rapidly with the rate of discharge of matte droplets in the slag; and then substantially levels off such that additional proportionate increases in the matte discharge rate do not yield similar proportionate increases in the reaction rate. For systems in which chemical reaction between two components can only occur at the phase interface, each reactant in a different phase, the overall reaction rate observed will be governed by the physical rate at which the reactant in under supply (as determined by the reaction stoichiometry) is brough to the interface. This is a function both of the fluid flow characteristics of each phase and the concentrations of the reactants in their respective phases, so as these change, the reaction rate in general will be controlled by one phase or the other. In FIG. 3, it can be seen that the reaction rate constants level off as the matte discharge rate increases, irrespective of which phase is governing the overall reaction rate. The steep initial rise of the curve, even on the logarithmic scale of FIG. 3, dramatically illustrates this effect.

Laboratory-scale experiments coupled with various calculations have indicated that the benefits of increased surface area of contact between the two liquids (i.e., the steeply rising portion of the curves of FIG. 3) increase substantially as the size of the drops of matte is reduced to the order of 1/100th centimeter. A further reduction in the size of matte drops, however, yields but little increase in the reaction rate and also slows the settling rate of the matte from the slag. This latter factor can be quite important, even if complete emulsification of the two liquids does not occur, since in the total time for any real process (e.g., the above-mentioned extraction of molybdenum from slag) there are actually two steps to consider. First, the dispersal of the matte in the slag to achieve the desired reaction and, second, the subsequent separation of the two liquid phases. As can be appreciated, a minor improvement in the reaction rate is hardly desirable if accompanied by a rather substantial increase in the separation time of the two liquid phases.

From the foregoing analysis, once the size of the reactor vessel (or the unit cell, discussed above) is specified, it is possible to determined optimum values for the parameters identified as important in the mixing of two liquid phases. For a given width, $W$, of a reactor vessel the paddle blade diameter, $D$, is specified as $D=W/3.5$. Then, for the value of $D$ thus determined, the rate of rotation of the paddle is chosen such that the blade of size $D=W/3.5$ will produce matte droplets of the desired size at the required rate. An appropriate speed can be calculated from the experimentally determined relation $ND^{1.3}=2200$, when $N$ is RPM and $D$ is in inches.

EXAMPLE

The above criteria were employed to design a mechanical agitator for a 10 ton slag treatment furnace having a vessel with internal dimensions of 8 × 4 inches and suitable for holding liquid to a total depth of 3 inches. In accordance with the concurrently filed patent application, mentioned above, entitled "Mechanically Stirred Electric Furnace for Pyrometallurgical Operations," the vessel was considered as two unit cells each of the square cross section with $W=4$ ft. Using the relations developed above, the parameters for the stirrers were specified as $D=13.7$ inches, $B=6$ inches and $N=73$ RPM. When the stirrers were operated in the range 75–100 RPM, rapid reaction rates were obtained in a process for recovering molybdenum from slag.

While a particular preferred embodiment of the present invention has been illustrated in the accompanying drawings and described in detail herein, other embodiments are within the scope of the present invention and the following claims.

I claim:

1. The method of promoting a reaction between a first denser material and a second lighter material, the materials having specific gravities differing by at least about 0.5, the method comprising the steps of maintaining both materials in a liquid state in a vessel defined by a square of side $W$ or by a circle of diameter $1.13W$, the second liquid having a depth $H$, supporting a stirrer with a blade assembly immersed in the lighter liquid and having a diameter of $D$ of approximately $0.1W$ to $0.4W$, and rotating said stirrer at a rate $N$ (RPM) such that the lower liquid is drawn up to the blade assembly, is pumped radially outward therefrom, and is formed into droplets by shear forces developed by said rotating blade assembly, and such that the upper liquid is circulated through a cloud of droplets thus formed, whereby a large area of contact between the liquids is produced without emulsification.

2. The method of claim 1 wherein said blade assembly comprises at least two paddle blades projecting from the axis of rotation of the stirrer at symmetrical locations.

3. The method of claim 1 wherein said blade assembly has a height, $B$, of approximately $0.05H$ to approximately $0.5H$.

4. The method of claim 1 further including the step of providing a baffle plate secured to said shaft above said blade assembly.

5. The method of promoting a reaction between a lighter slag and a denser matte, comprising the steps of maintaining said slag over said matte, both in a molten state in a vessel defined by a square of side W or by a circle of diameter 1.13W, continuously drawing matte up into the slag at substantially the center of said vessel, continuously pumping said drawn up matte radially outward from said center, dividing said outwardly pumped matte into a cloud of droplets, circulating said slag through said cloud of droplets, and settling said droplets back into the matte remaining beneath the slag.

6. The method of claim 5 wherein said pumping is accomplished with a bladed stirrer positioned in said slag.

7. In a pyrometallurgical system comprising a vessel containing a lower denser liquid and an upper lighter liquid defined by a square of side *W* and said upper liquid having a depth *H*, the improvement wherein said stirrer is for the non-emulsifying mixing of said lower liquid into said upper liquid, said stirrer comprising a paddle comprising a shaft a blade assembly of diameter *D* secured to said shaft, where D is approximately 0.1*W* to 0.4*W*, means for supporting said blade assembly in said upper liquid centered in said square above the interface of said upper and lower liquids, and means for rotating said paddle at a rate *N* (RPM), such that the lower liquid is drawn up to the blade assembly, is pumped radially outward therefrom, and is formed into droplets by shear forces developed by said rotating blade assembly, and such that the upper liquid is circulated through a cloud of droplets thus formed, whereby a large area of contact between the liquids is produced without emulsification.

8. The system of claim 7 wherein said blade assembly comprises at least two paddle blades projecting from the axis of rotation of the stirrer at symmetrical locations.

9. The system of claim 7 wherein said blade assembly has a height, *B*, of approximately 0.05*H* to approximately 0.5*H*.

10. The system of claim 7 further including a baffle plate secured to said shaft above said blade assembly.

11. The system of claim 7 including multiple unit cells within the vessel.

12. The system of claim 7 wherein said stirrer is rotated at a rate such that said droplets have a diameter of the order of 1/100th centimeter.

13. In a pyrometallurgical system comprising a vessel containing a lower denser liquid and an upper lighter liquid and a mechanical stirrer projecting into said vessel, said vessel defined by a square of side *W* and depth *H*, the improvement wherein said stirrer is for the non-emulsifying mixing of said lower denser liquid into said upper lighter liquid, said stirrer comprising a paddle conprising a shaft, a blade assembly of diameter *D* secured to said shaft, where *D* is approximately 0.1*W* to 0.4*W*, a baffle plate secured to said shaft above said blade assembly, means for supporting said paddle with said blade assembly and said baffle plate submerged in said upper liquid, and means for rotating said paddle.

14. The system of claim 13 wherein said paddle is rotated at a rate, *N* (RPM), such that the lower liquid is drawn up to the blade assembly, is pumped radially outward therefrom, and is formed into droplets by shear forces developed by said rotating blade assembly, and such that the upper liquid is circulated through a cloud of droplets thus formed; whereby a large area of contact between the liquids is produced without emulsification.

15. The system of claim 13 wherein said blade assembly comprises at least two paddle blades projecting from the axis of rotation of the stirrer at symmetrical locations.

16. The system of claim 13 wherein said blade assembly has a height, *B*, of approximately 0.05*H* to approximately 0.5*H*.

17. The system of claim 13 wherein said stirrer is rotated at a rate such that said droplets have a diameter of the order of 1/100th centimeter.

18. The system of claim 13 including multiple cells within the vessel.

19. In a pyrometallurgical system comprising a vessel containing a lower denser liquid and an upper lighter liquid defined by a circle of diameter 1.13*W* and said upper liquid having a depth *H*, the improvement wherein said stirrer is for the non-emulsifying mixing of said lower liquid into said upper liquid, said stirrer comprising a paddle comprising a shaft a blade assembly of diameter *D* secured to said shaft, where *D* is approximately 0.1*W* to 0.4*W*, means for supporting said blade assembly in said upper liquid centered in said square above the interface of said upper and lower liquids, and means for rotating said paddle at a rate *N* (RPM), such that the lower liquid is drawn up to the blade assembly, is pumped radially outward therefrom, and is formed into droplets by shear forces developed by said rotating blade assembly, and such that the upper liquid is circulated through a cloud of droplets thus formed, whereby a large area of contact between the liquids is produced without emulsification.

20. The system of claim 19 wherein said blade assembly comprises at least two paddle blades projecting from the axis of rotation of the stirrer at symmetrical locations.

21. The system of claim 19 further including a baffle plate secured to said shaft above said blade assembly.

22. The system of claim 19 including multiple unit cells within the vessel.

23. The system of claim 19 wherein said stirrer is rotated at a rate such that said droplets have a diameter of the order of 1/100th centimeter.

24. In a pyrometallurgical system comprising a vessel containing a lower denser liquid and an upper lighter liquid and a mechanical stirrer projecting into said vessel, said vessel defined by a circle of diameter 1.13*W* and depth *H*, the improvement wherein said stirrer is for the non-emulsifying mixing of said lower denser liquid into said upper lighter liquid, said stirrer comprising a paddle comprising a shaft a blade assembly of diameter *D* secured to said shaft, where *D* is approximately 0.1*W* to 0.4*W*, a baffle plate secured to said shaft above said blade assembly, means for supporting said paddle with said blade assembly and said baffle plate submerged in said upper liquid, and means for rotating said paddle.

25. The system of claim 24 wherein said paddle is rotated at a rate, $N$ (RPM), such that the lower liquid is drawn up to the blade assembly, is pumped radially outward therefrom, and is formed into droplets by shear forces developed by said rotating blade assembly, and such that the upper liquid is circulated through a cloud of droplets thus formed; whereby a large area of contact between the liquids is produced without emulsification.

26. The system of claim 24 wherein said blade assembly comprises at least two paddle blades projecting from the axis of rotation of the stirrer at symmetrical locations.

27. The system of claim 24 wherein said blade assembly has a height, $B$, of approximately $0.05H$ to approximately $0.5H$.

28. The system of claim 24 wherein said stirrer is rotated at a rate such that said droplets have a diameter of the order of 1/100th centimeter.

29. The system of claim 24 including multiple cells within the vessel.

* * * * *